US009378917B2

(12) United States Patent
Yoshida et al.

(10) Patent No.: US 9,378,917 B2
(45) Date of Patent: Jun. 28, 2016

(54) CHIP-TYPE FUSE

(71) Applicant: MATSUO ELECTRIC CO., LTD., Osaka (JP)

(72) Inventors: Yasushi Yoshida, Osaka (JP); Koji Hirakura, Osaka (JP)

(73) Assignee: MATSUO ELECTRIC CO., LTD., Osaka (JP)

( * ) Notice: Subject to any disclaimer, the term of this patent is extended or adjusted under 35 U.S.C. 154(b) by 232 days.

(21) Appl. No.: 14/372,948

(22) PCT Filed: Feb. 15, 2013

(86) PCT No.: PCT/JP2013/053670
§ 371 (c)(1),
(2) Date: Jul. 17, 2014

(87) PCT Pub. No.: WO2013/125461
PCT Pub. Date: Aug. 29, 2013

(65) Prior Publication Data

US 2015/0002258 A1 Jan. 1, 2015

(30) Foreign Application Priority Data

Feb. 20, 2012 (JP) ..... 2012-033875

(51) Int. Cl.
*H01H 85/143* (2006.01)
*H01H 85/18* (2006.01)
(Continued)

(52) U.S. Cl.
CPC ..... *H01H 85/143* (2013.01); *H01H 69/02* (2013.01); *H01H 85/0021* (2013.01);
(Continued)

(58) Field of Classification Search
CPC ... H01H 85/18; H01H 85/143; H01H 85/175; H01H 85/0021; H01H 85/38; H01H 69/02; H01H 2223/002; H01H 85/147; H01H 2085/0275
USPC ..... 337/273
See application file for complete search history.

(56) References Cited

U.S. PATENT DOCUMENTS 4,559,514 A * 12/1985 Arikawa ..... H01H 85/0411 337/201
4,599,596 A * 7/1986 Arikawa ..... H01H 85/0411 337/201

(Continued)

FOREIGN PATENT DOCUMENTS

JP 47-10822 Y1 4/1972
JP 11-273541 A 10/1999

(Continued)

OTHER PUBLICATIONS

International Search Report dated Mar. 5, 2013 from International Application No. PCT/JP2013/053670.

*Primary Examiner* — Anatoly Vortman
(74) *Attorney, Agent, or Firm* — Duane Morris LLP

(57) ABSTRACT

A terminal-integrated fuse (2) includes two planar members (10), (10) serving as terminals for mounting on a substrate. The two planar members (10), (10) are spaced on a same horizontal plane. A fuse body (4) is located on a horizontal plane at a level different from the level of the said horizontal plane and between the planar members (10), (10). The fuse body (4) is formed integral with the planar members (10), (10). A casing (14) has side walls (18), (20) and end walls (22), (24) disposed around an opening. The fuse body (4) is positioned in the casing (14), and the two planar members (10, (10) are in contact with the end walls (22), (24), respectively. An arc suppressing material portion (26) is provided in the casing (14) in such a manner the fuse body (4) is embedded therein.

10 Claims, 7 Drawing Sheets

(51) Int. Cl.

| | |
|---|---|
| ***H01H 85/175*** | (2006.01) |
| ***H01H 69/02*** | (2006.01) |
| ***H01H 85/38*** | (2006.01) |
| ***H01H 85/00*** | (2006.01) |
| *H01H 85/147* | (2006.01) |
| *H01H 85/02* | (2006.01) |

(52) U.S. Cl.
CPC ..... *H01H 85/175* (2013.01); *H01H 85/18* (2013.01); *H01H 85/38* (2013.01); *H01H 85/147* (2013.01); *H01H 2085/0275* (2013.01); *H01H 2223/002* (2013.01)

(56) References Cited

U.S. PATENT DOCUMENTS 4,626,818 A * 12/1986 Hilgers ..... H01H 85/046 257/E23.149
5,363,082 A * 11/1994 Gurevich ..... H01H 85/0411 29/623
5,432,378 A * 7/1995 Whitney ..... H01H 85/046 257/529
5,453,726 A * 9/1995 Montgomery ..... H01H 85/046 29/623
5,712,610 A * 1/1998 Takeichi ..... H01H 85/046 29/623
5,726,620 A * 3/1998 Arikawa ..... H01H 85/157 337/186
6,002,322 A 12/1999 Krueger et al.
6,034,589 A * 3/2000 Montgomery ..... H01H 85/0411 29/623
8,368,502 B2 * 2/2013 Washizaki ..... H01H 85/0418 29/623
2008/0191832 A1 * 8/2008 Tsai ..... H01H 69/022 337/297

FOREIGN PATENT DOCUMENTS

JP 2004-152518 5/2004
JP 4316729 B 8/2009

* cited by examiner

CHIP-TYPE FUSE

TECHNICAL FIELD

This invention relates to a chip-type fuse and, more particularly, to such fuse with a fuse and terminals formed integrally.

BACKGROUND ART

An example of prior chip-type fuses with integrally formed fuse and terminals is disclosed in Patent Literature 1. According to Patent Literature 1, a fusible link is disposed to extend from one end to the other of an upper surface of a rectangular parallelepiped substrate. There are provided pads on the upper, side and bottom surfaces in the two end portions of the substrate. The fusible link and pads are electrically coupled together and are simultaneously formed by copper plating process or PVD. An additional layer of conductive metal is provided on the surfaces of the fusible link and the pads. A protective layer is formed over the upper surface of the substrate on which the pads and the fusible link are formed thereon.

PRIOR TECHNIQUE LITERATURES

Patent Literature

Patent Literature 1: JP4316729B (Equivalent to U.S. Pat. No. 6,002,322)

DISCLOSURE OF INVENTION

Problem to be Solved by Invention

The technique according to Patent Literature 1 can provide a chip-type fuse having a fusible link and pads formed integral with each other, but it requires a troublesome manufacturing process of copper plating a substrate, then, forming the fusible link and pads by etching, forming an additional layer thereon by photoetching, and, further, forming a protective layer thereover.

An object of the present invention is to provide a chip-type fuse with integrally formed fuse and terminals which can be manufactured with ease.

SOLUTION TO PROBLEM

A chip-type fuse according to an embodiment of the present invention includes a terminal-integrated fuse. The terminal-integrated fuse includes two planar members for terminals for mounting on a substrate. The two planar terminal members are disposed on the same horizontal plane and spaced from each other. The fuse is disposed in a position between the two planar members on a horizontal plane which is at a different level from the level at which the plane on which the planar members are disposed. The fuse is integrated with the two planar members. The terminal-integrated fuse may be manufactured by pressing an electrically conductive metal, for example. The chip-type fuse according to the embodiment has a casing, too. The casing has one side closed and has the other side thereof on a different plane from the one side opened. The casing has a peripheral wall extending from the periphery of the opening thereof toward the said one side. The casing may be, for example, a hollow cube, for example, a hollow rectangular parallelepiped, having its one side opened. In this casing, the fuse is positioned intermediate between the open side and the closed side, and the two planar members are in contact with the peripheral wall. An arc suppressing material portion is provided for the fuse in this casing.

With this arrangement, the fuse is positioned within the casing with the two planar members placed to be in contact with the peripheral wall of the casing, which enables easy manufacturing of chip-type fuses.

The fuse may be joined integral with the respective edges, nearer to the opening, of the two planar members. When this arrangement is employed, a riser rises upward toward the one side from the outer edge portion of each of the two planar members located on the outer surface side of the peripheral wall. The risers of the two planar members extend upward, being in contact with the peripheral wall. This arrangement makes it possible to securely position the fuse within the casing.

Further, the edge of each of the two planar members nearer to the opening may be placed in contact with the periphery of the opening. In this case, a sloping member slopes toward the central area of the casing from each of the edges of the two planar members nearer to the opening, and the fuse is formed integral with the distal edges of the sloping members. This arrangement enables easy positioning of the terminal-integrated fuse, resulting in easier manufacturing of the chip-type fuse.

The arc suppressing material portion may be arranged to embed the fuse therein in the casing. For example, the arc suppressing material portion may fill completely the casing. Employing such arrangement, the mounting of the arc suppressing material portion to the fuse becomes easy.

The opening of the casing may be closed with a lid, e.g. a ceramic lid, whereby the thermostability of the chip-type fuse is improved.

In the described embodiment, the arc-suppressing material portion may be disposed only in the vicinity of the opposing ends of the fuse. For example, the arc suppressing material portion may be disposed only on one surface of each of the two ends of the fuse, or may be disposed to enclose each of the two ends of the fuse. This arrangement can stabilize the fuse performance by preventing chemical reaction of the arc suppressing material since the portions in the vicinity of the two ends of the fuse are kept cooler than the center portion even when the fuse generates heat.

The opening of the casing may be sealed up. The sealing up of the opening may be done by, for example, placing a plate member over the opening or by placing a plate member within the casing and forming a resin layer in the space between the plate member and the opening. The sealing the opening can improve the thermostability of the chip-type fuse.

EMBODIMENTS OF INVENTION

A chip-type fuse according to a first embodiment of the present invention is a surface-mounted fuse, which may be used in an automobile or for a lithium cell.

Figure 1:
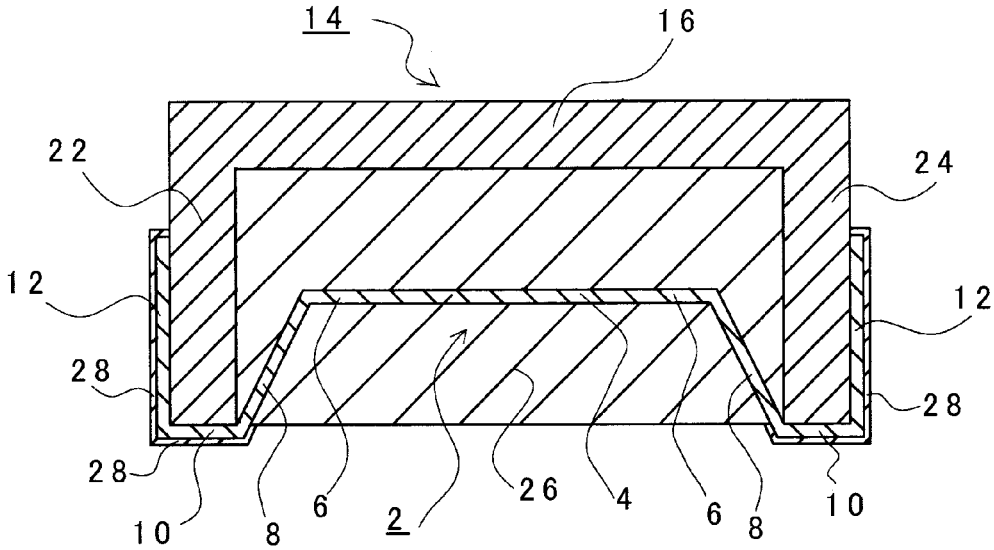
FIG. 1 shows a longitudinal cross-section viewed from one side of a chip-type fuse according to a first embodiment of the present invention.
Figure 2:
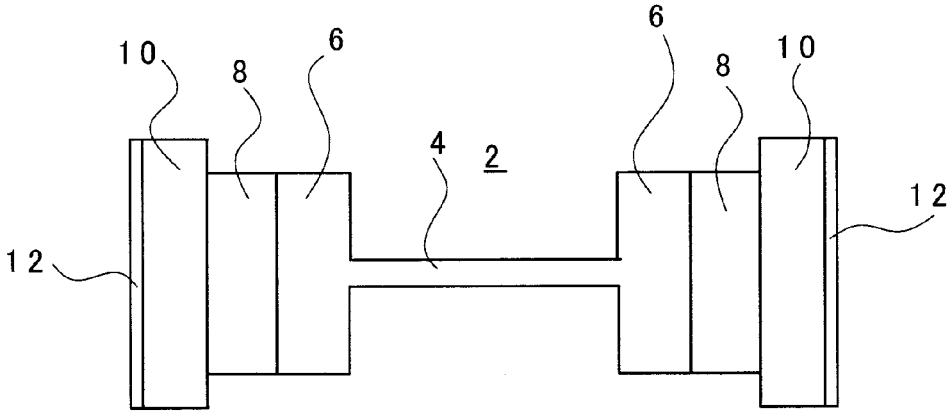
FIG. 2 is a plan view of a terminal-integrated fuse for use in the chip-type fuse of FIG. 1.

The chip-type fuse includes a terminal-integrated fuse 2 as shown in FIG. 1. The terminal-integrated fuse 2 has a fuse body 4, which is straight, to be positioned in a horizontal plane, as shown in FIGS. 1 and 2. Coupling members 6, 6 are formed at the respective ends of the fuse body 4, being integrated with the fuse body 4 in such a manner as to be positioned in the same plane as the fuse body 4. The coupling members 6 are rectangular in shape. Each of the coupling members 6, 6 has a pair of longer edges longer than the width of the fuse body 4, and the two ends of the fuse body 4 are coupled to the respective ones of the longer edges of the coupling members 6, 6.

Sloping members 8, 8 are coupled respectively to the longer edges of the fuse body 4 which are opposite to the longer edges to which the coupling members 6, 6 are joined. The sloping members 8, 8 are formed also in a rectangular shape. Pairs of longer edges of the sloping members 8, 8 have the same length as the longer edges of the coupling members 6, 6, and the coupling members 6, 6 and the sloping members 8, 8 are coupled together along their corresponding longer edges. The sloping members 8, 8 are positioned in such a manner that they extend outward at an obtuse angle to the respective coupling members 6, 6. The respective other longer edges of the sloping members 8, 8 are in a plane at a different level from the horizontal plane in which the fuse body 4 lies.

Rectangular planar members 10, 10 are positioned in this horizontal plane. The planar members 10, 10 are located outward of the corresponding sloping members 8, 8. The respective ones of the other longer edges of the sloping members 8, 8 are coupled integrally with corresponding ones of the edges of the planar members 10, 10. The longer edges of the planar members 10, 10 are longer than the longer edges of the coupling members 6, 6 and the longer edges of the sloping members 8, 8. A riser 12 is formed integral with the longer edge of each of the planar members 10, 10, which longer edge is located opposite to the longer edge of that planar member 10 to which the corresponding sloping member 8 is coupled. The risers 12, 12 extend upward substantially perpendicularly to the planar members 10, 10 to the side where the fuse body 4 is located. The two planar members 10, 10 and the two risers 12, 12 form terminals.

Describing in a different way, the fuse body 4 is located at a position between the two planar members 10, 10, but on a horizontal plane different from the horizontal plane on which the planar members 10, 10 are located, and is integrated with the planar members 10, 10 with the coupling members 6, 6 and the sloping members 8, 8 disposed therebetween.

The terminal-integrated fuse 2 may be made by, for example, pressing a sheet of, for example, copper or a copper alloy. The rated allowable current of the fuse body 4 may be 50 A, for example.

Figure 3:
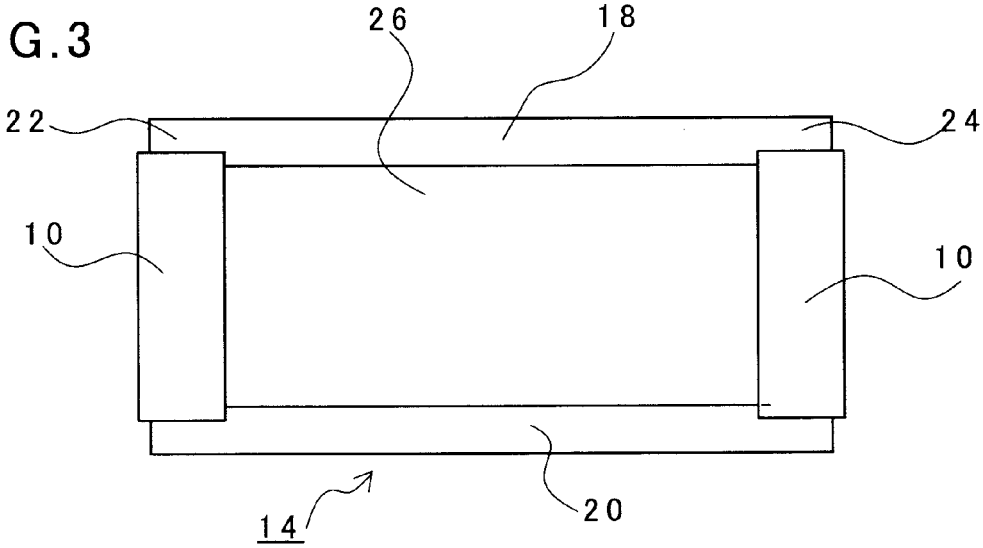
FIG. 3 is a bottom view of the chip-type fuse of FIG. 1.

The terminal-integrated fuse 2 is disposed relative to a casing 14 in such a manner that its fuse body 4 can be located within the casing 14. The casing 14 is formed in a generally rectangular parallelepiped shape, for example, and ceramics is used for the casing 14 from the viewpoint of thermostability and strength. The casing 14 is hollow and includes a main wall 16 in a generally rectangular shape. The casing 14 has an opening in the side opposite to the main wall 16. A peripheral wall is provided to extend around the opening. As part of the peripheral wall, side walls 18 and 20, for example, extend along and perpendicularly to respective two longer edges of the main wall 16 as shown in FIG. 3. The remaining parts of the peripheral wall are end walls 22 and 24 which extend along and perpendicularly to respective two shorter edges of the main wall 16. The dimensions of the casing 14 are, for example, 6 mm long, 4.0 mm wide, and 3 mm high.

When the fuse body 4 is positioned in the casing 14, the planar members 10, 10 come into contact with the end walls 22 and 24, respectively. In this position, the intersections between the sloping members 8, 8 and the corresponding planar members 10, 10 are in contact with the edges of the end walls 22 and 24 adjacent to the opening, and the sloping members 8, 8 and the planar members 10, 10 are in contact with the inner surfaces of the respective side walls 18 and 20. Further, the risers 12, 12 are in contact with the outer surfaces of the respective end walls 22 and 24. In other words, the thickness of the end walls 22 and 24 is substantially equal to the dimension between the longer edges of the planar members 10, 10. As shown in FIG. 3, the length of the longer edges of the planar members 10, 10 is a little smaller than the length of the end walls 22 and 24. In this state, the fuse body 4 is located between the main wall 16 and the opening.

A layer 26 of arc suppressing material, e.g. silicone resin or cement, is provided to fill the entire inner space of the casing so that the fuse body 4 is embedded therein. Silicone resin is employed because it has rubber-like elasticity, is thermally stable and is not carbonized, and cement is employed because it is thermally stable and is not carbonized.

Plating layers 28 are formed over the outer surfaces of the planar members 10, 10 and the risers 12, 12. The plating layers 28 are used to solder the planar members 10, 10 to a substrate (not shown), e.g. a printed circuit board.

Figure 4:
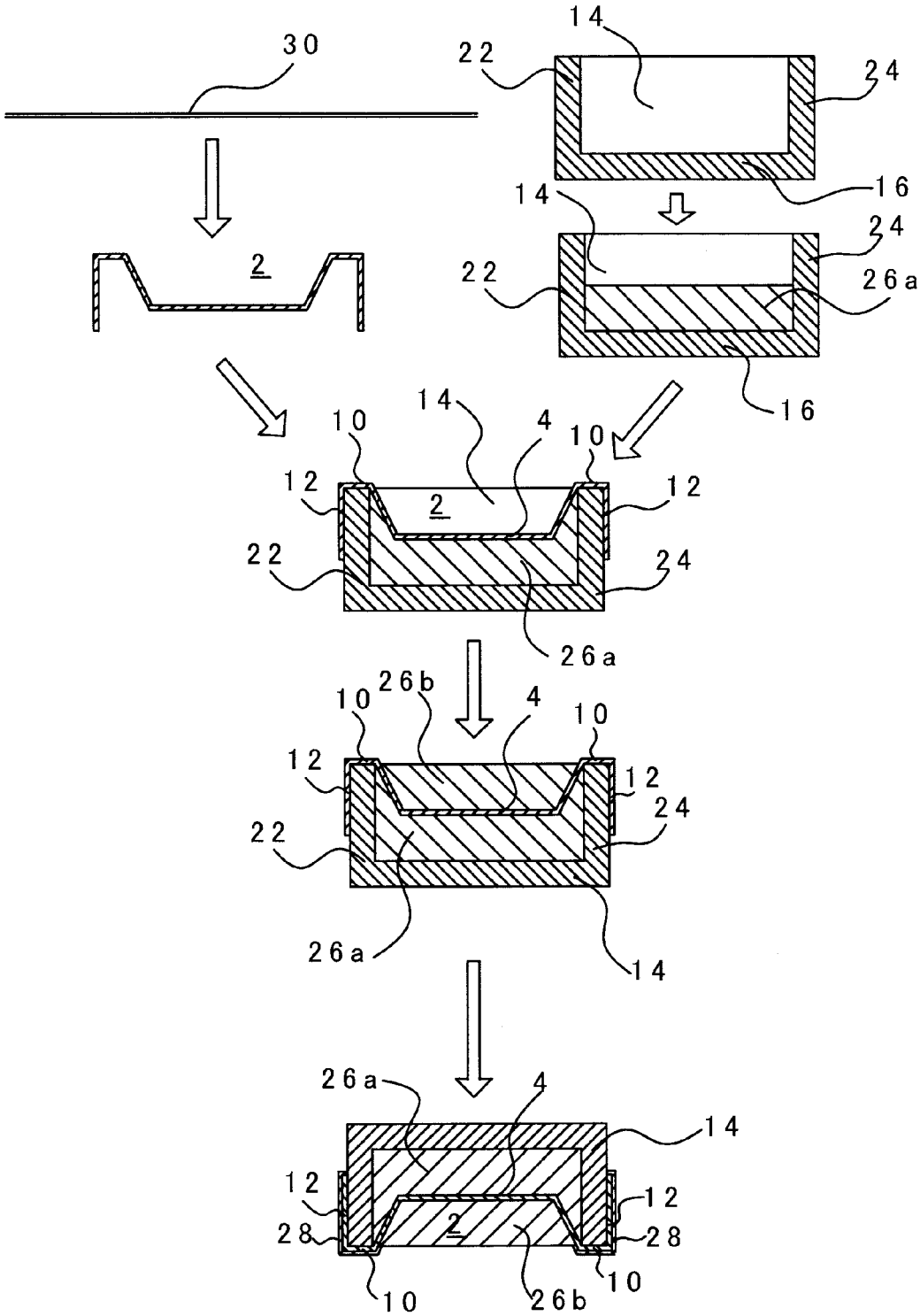
FIG. 4 shows a process of manufacturing the chip-type fuse of FIG. 1.

The chip-type fuse described is manufactured in a manner shown in FIG. 4. First, a copper or copper alloy sheet 30 is pressed into the terminal-integrated fuse 2. Simultaneously, the casing 14 is manufactured.

With the casing 14 kept such that the main wall 16 is positioned to be the bottom, liquid silicone resin 26*a* is poured into the casing 14 to a depth about the half the height of the main wall 16.

Next, the terminal-integrated fuse 2 is disposed in the casing 14 in such a position that the fuse body 4 is disposed within the casing 14, the planar members 10, 10 are in contact with the corresponding end walls 22 and 24, and the risers 12, 12 are in contact with the outer surface of the casing 14. In this position, the junctions between the respective ones of the sloping members 8 and the corresponding coupling members 6 are in contact with the corresponding edges of the end walls 22 and 24 nearer to the opening, with the risers 12, 12 being in contact with the outer surface of the casing 14, whereby the position of the terminal-integrated fuse 2 with respect to the length direction of the fuse body 4 is determined.

After that, liquid silicone resin 26*b* is poured to such a depth that at least the fuse body 4 is embedded. Then, the silicone resins 26*a* and 26*b* are cured to complete the arc suppressing material portion 26. Finally, the plating layers 28 are formed over the outer surfaces of the planar members 10, 10 and over the outer surfaces of the risers 12, 12.

As described, the chip-type fuse is fabricated by placing the silicone resin 26*a* in the casing 14, then placing the terminal-integrated fuse 2 within the casing 14, placing the remaining silicone resin 26*b*, and plating the planar members 10, 10 of the terminals and the risers 12, 12. The manufacturing of this chip-type fuse is simpler than the conventional manufacturing process in which a substrate is plated, then, etching is done, and, after that, plating is carried out. In addition, since a planar layer, e.g. a Cu layer, having a relatively large thickness can be used as a fuse base material, large current of, for example, 50 A can be handled. Also, since the fuse body 4 and terminal electrodes for use in mounting the fuse including the planar members 10 are integrated, no unnecessary resistive components, which would otherwise be required for connecting the fuse body 4 to the planar members 10, are developed, whereby reliable fuses can be produced.

Furthermore, integration of the fuse with terminal electrodes eliminates necessity for securing spaces for the interconnection therebetween, and therefore relatively small-sized fuses can be obtained.

Figure 5:
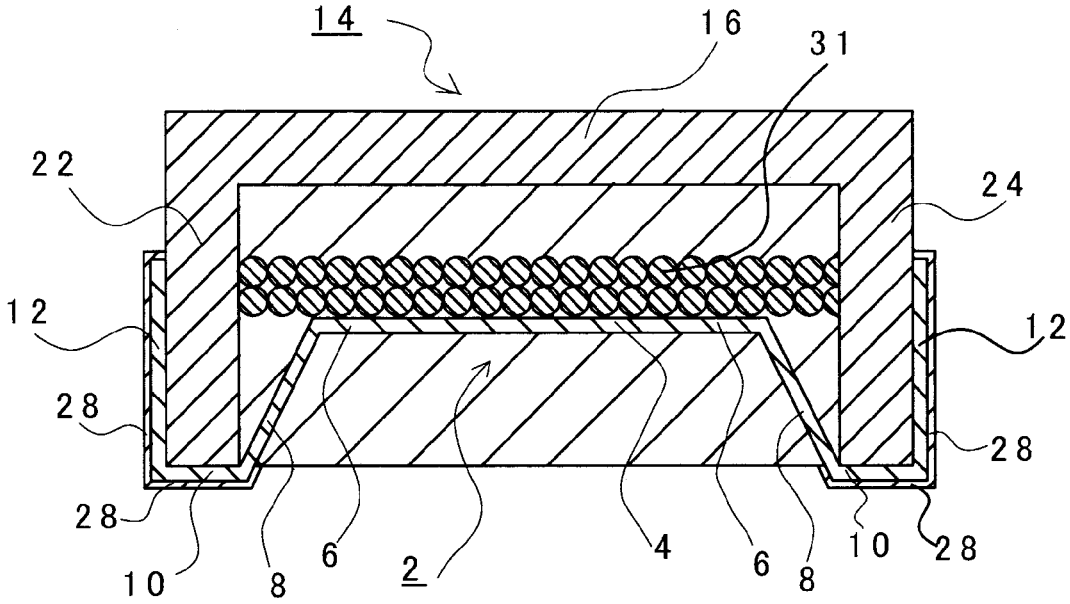
FIG. 5 shows a longitudinal cross-section viewed from one side of a chip-type fuse according to a second embodiment of the present invention.

A chip-type fuse according to a second embodiment is shown in FIG. 5. The chip-type fuse of this second embodiment has the same structure as the chip-type fuse of the first embodiment except that a bead layer 31 is added as an arc suppressing material layer. The same reference numerals are used for the same components, and their description is not given. The bead layer 31 is disposed within the arc suppressing material portion 26 such that it is in contact with the surfaces of the fuse body 4 and the coupling members 6 on the side nearer to the main wall 16. The bead layer 31 consists of a plurality of spherical glass beads or spherical hollow glass beads, which are placed to form plural layers. The spherical glass beads or spherical, hollow glass beads are not interconnected with each other.

When such bead layer 31 is formed in the casing 14, there are gaps between adjacent beads. The volume of the gaps in total can be about 30% of the volume of the casing 14, for example. When the fuse body 4 fuses, the pressure within the casing 14 tends to increase due to the fusing of the fuse body 4, but the gaps within the casing 14 allow the increasing pressure to escape thereinto, which results in improvement of the arc suppressing performance. Furthermore, since the glass beads or hollow glass beads have a softening point lower than that of the fuse body 4, they are softened by the heat radiated by the molten fuse and re-cured to capture the molten fuse therein.

The bead layer 31 is formed by placing spherical glass beads or spherical hollow glass beads in a plurality of layers on the silicone resin 26*a* after placing the silicone resin 26*a* and before placing the terminal-integrated fuse 2 in the casing 14 in the process shown in FIG. 4. Alternatively, a plurality of layers of glass beads or hollow glass beads may be formed before the terminal-integrated fuse 2 is placed in the casing 14, without placing the silicone resin 26*a*.

Figure 6:
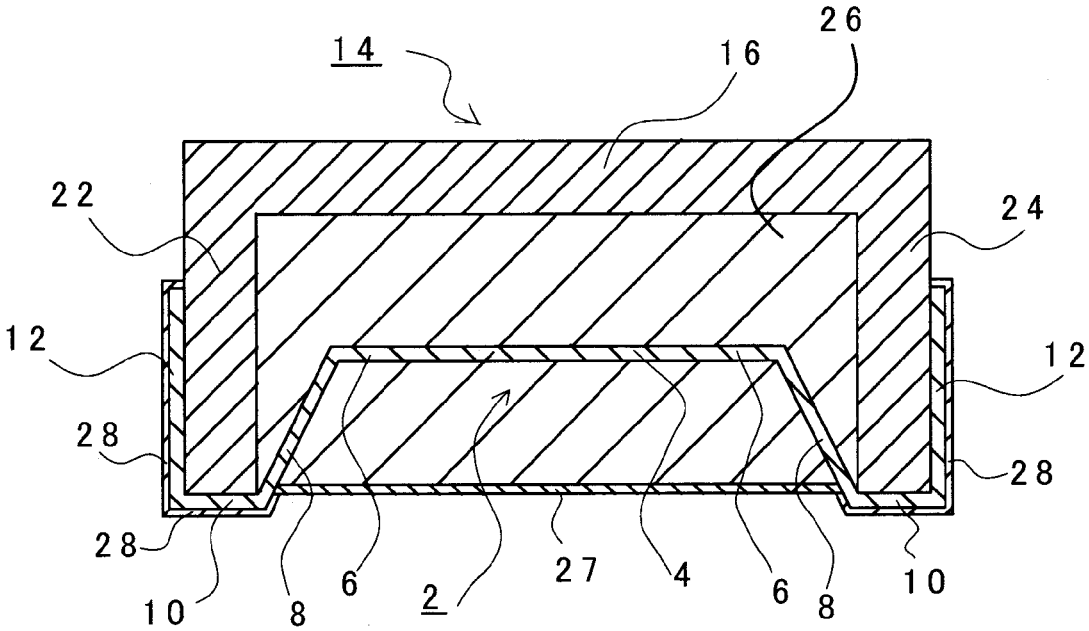
FIG. 6 shows a longitudinal cross-section viewed from one side of a chip-type fuse according to a third embodiment of the present invention.

FIG. 6 shows a chip-type fuse according to a third embodiment.

This chip-type fuse is same as the chip-type fuse shown in FIG. 1 except that a lid 27 of ceramics, for example, is used to close the opening of the casing 14. The same reference numerals are attached to the same components as those of the chip-type fuse of the first embodiment, and their description is not given. The use of the lid 27 improves the thermostability of the chip-type fuse. The lid 27 may be used for the chip-type fuse according to the second embodiment as in this chip-type fuse, too.

Figure 7:
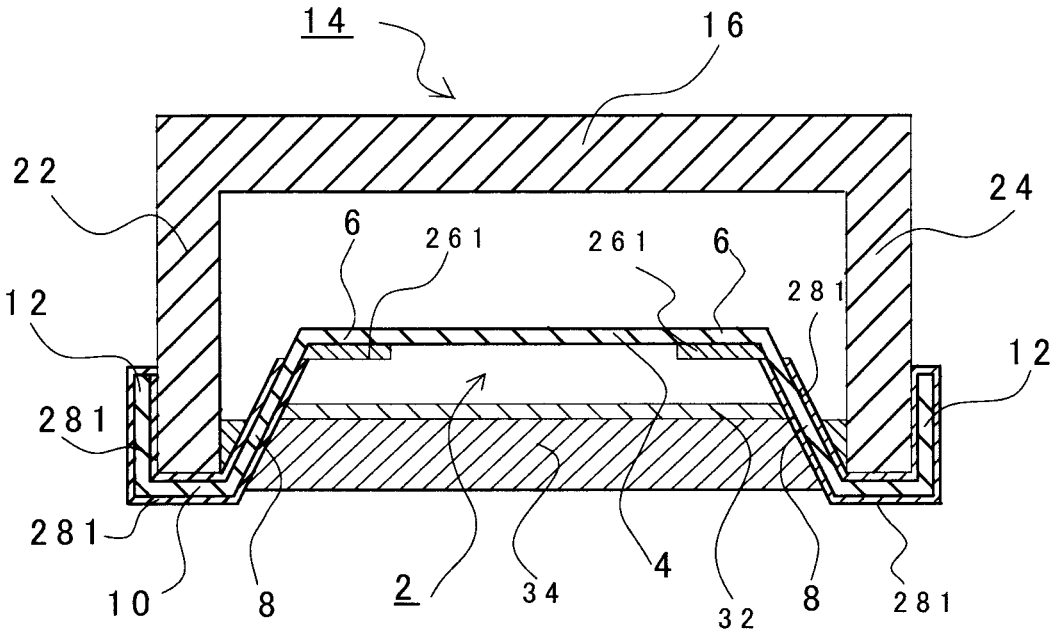
FIG. 7 shows a longitudinal cross-section viewed from one side of a chip-type fuse according to a fourth embodiment of the present invention.

FIG. 7 shows a chip-type fuse according to a fourth embodiment. While the arc suppressing material portion 26 is provided for the entire portion of the casing 14 in the chip-type fuse according to the first embodiment, the chip-type fuse of FIG. 7 has arc suppressing portions 261, 261 consisting of silicone resin layers, for example, only on the surfaces, facing to the opening, of the coupling members 6, 6 at the opposite ends of the fuse body 4, and there is nothing disposed between the fuse body 4 and the main wall 16. The remaining portions are of the same structures as the chip-type fuse according to the first embodiment, and therefore, the same reference numerals is used for the same components of the chip-type fuse of the first embodiments, and their description is not given.

Let it be assumed that a chip-type fuse with a large rated allowable current is fabricated, in which the arc suppressing material portion is formed in the entire portion of the interior of the casing 14 as in the first embodiment. When large current flows through the fuse body 4, the temperature of the fuse body 4 rises, causing chemical reaction of the arc suppressing material. This may cause white smoke to be emitted by the arc suppressing material portion. In order to prevent it and, at the same time, to prevent generation of arc when the fuse body 4 fuses, the arc suppressing material portions 261, 261 are formed only on the coupling members 6, 6.

Furthermore, the chip-type fuse according to this embodiment includes a plate member 32 of ceramics, for example, disposed to extend between intermediate portions of the sloping members 8, 8. A sealant resin layer, e.g. a silicone resin layer, 34 is disposed between the plate member 32 and the opening of the casing 14. The opening is sealed up with the plate member 32 and the silicone resin layer 34, whereby the thermostability of the chip-type fuse is improved. A layer of other resins, e.g. an epoxy resin layer, can be used as the sealant resin layer in place of the silicone resin layer.

Further, the chip-type fuse according to this embodiment includes plating layers 281, 281 which cover the entire inner and outer surfaces of the respective risers 12, 12, the entire inner and outer surfaces of the respective planar members 10, 10 and the inner and outer surfaces of part of the respective sloping members 8, 8.

Figure 8:
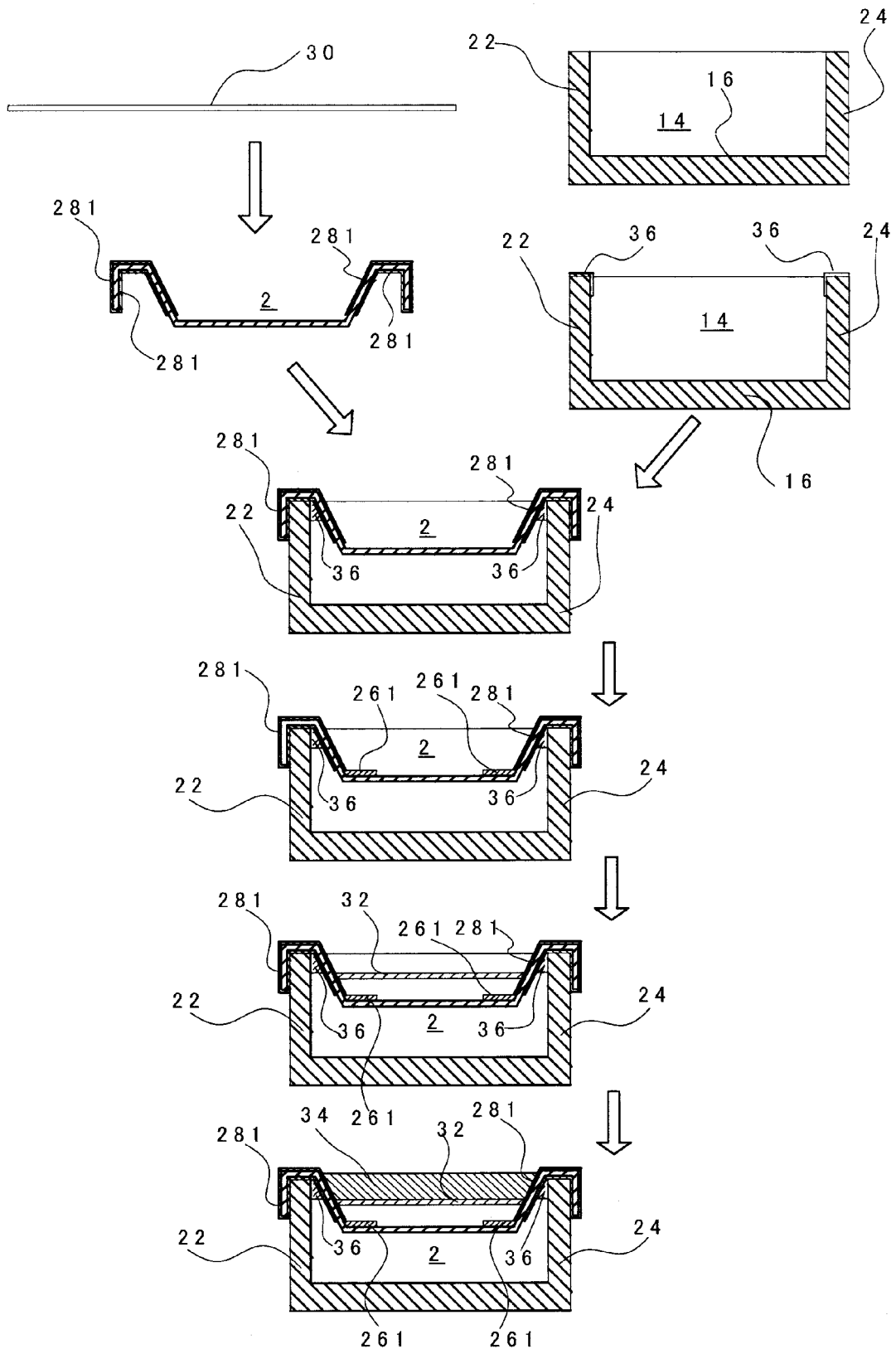
FIG. 8 shows a process of manufacturing the chip-type fuse of FIG. 7.

FIG. 8 shows a process for manufacturing the chip-type fuse according to the fourth embodiment. First, a sheet 30 of copper or copper alloy is pressed to form the terminal-integrated fuse 2. Next, the plating layers 281, 281 are formed on the terminal-integrated fuse 2, and, at the same time, an adhesive 36, 36 is applied over the surfaces, facing to the opening, of the end walls 22 and 24 of the casing 14 with the main wall 16 disposed as a bottom, and also over the inner surfaces continuous thereto.

Next, the terminal integrated fuse 2 is positioned in the casing 14 in such a manner that the fuse body 4 is within the casing 14, the planar members 10, 10 are in contact respectively with the end walls 22 and 24, and the risers 12, 12 are in contact with the outer surfaces of the casing 14. This causes the terminal-integrated fuse 2 to be bonded to the casing 14 with the adhesive 36, 36.

After that, the arc suppressing material layers 261, 261 are formed on the coupling members 6, 6, and, thereafter, the plate member 32 is disposed and the silicone resin layer 34 is formed.

Figure 9:
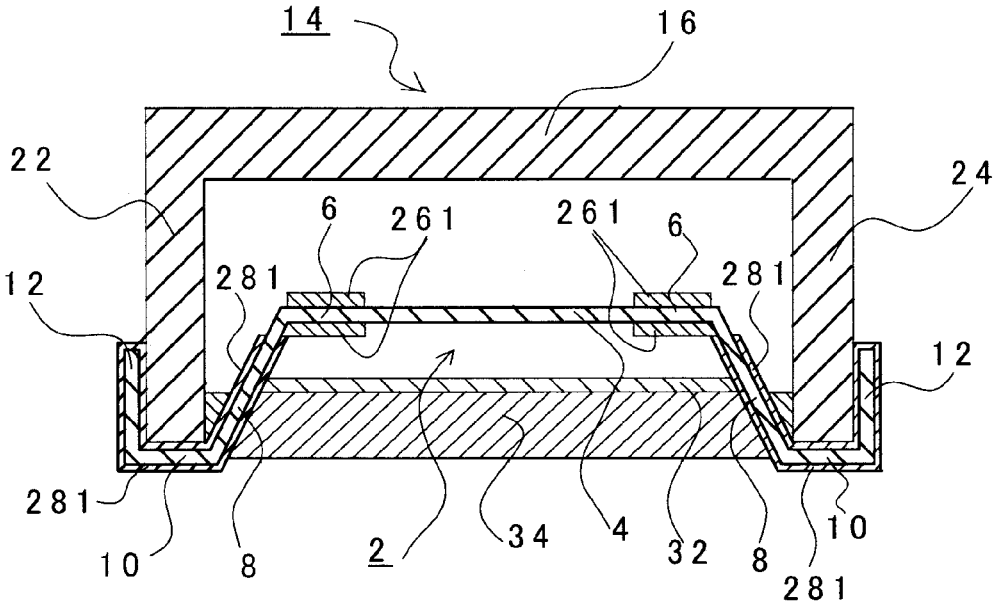
FIG. 9 shows a longitudinal cross-section viewed from one side of a chip-type fuse according to a fifth embodiment of the present invention.

FIG. 9 shows a chip-type fuse according to a fifth embodiment. The chip-type fuse according to the fifth embodiment has the arc suppressing material layers 261, 261 formed additionally on the surfaces of the coupling members 6 facing the main wall 16. The remaining structure is the same as the chip-type fuse according to the fourth embodiment. The components as used in the chip-type fuse according to the fourth embodiment have, attached thereto, the same reference numerals as used for the chip-type fuse according to the fourth embodiment, and their description is not given. The provision of the arc suppressing layers 261, 261 on the surfaces of the coupling members 6, 6 facing the main wall 16 and on the surfaces facing the opening can improve the arc suppressing performance.

Figure 10:
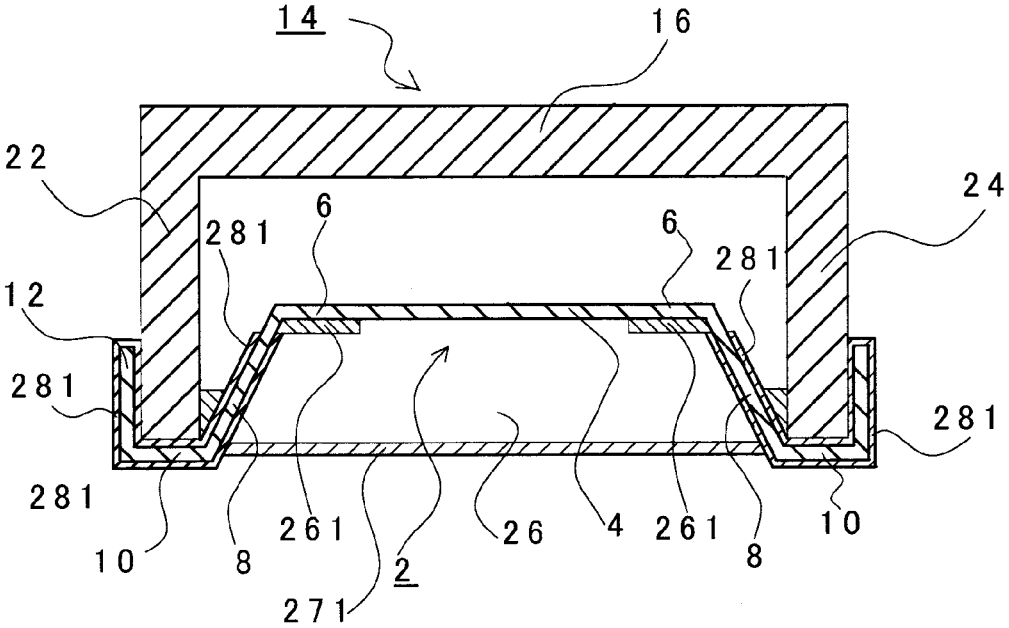
FIG. 10 shows a longitudinal cross-section viewed from one side of a chip-type fuse according to a sixth embodiment of the present invention.

FIG. 10 shows a chip-type fuse according to a sixth embodiment. According to this embodiment, the sealing of the opening is provided only by a lid 271 of, for example, ceramics. The arrangement of the remaining components is the same as in the fourth embodiment. The reference numerals used in the fourth embodiment are used for the same components, and their description is not given. Since the sealing of the opening is provided only by the lid 217, the manufacture of the chip-type fuse is simpler. It should be noted that the opening of the casing 14 of the chip-type fuse of the fifth embodiment may be closed only by the lid 271 as in this embodiment.

Figure 11:
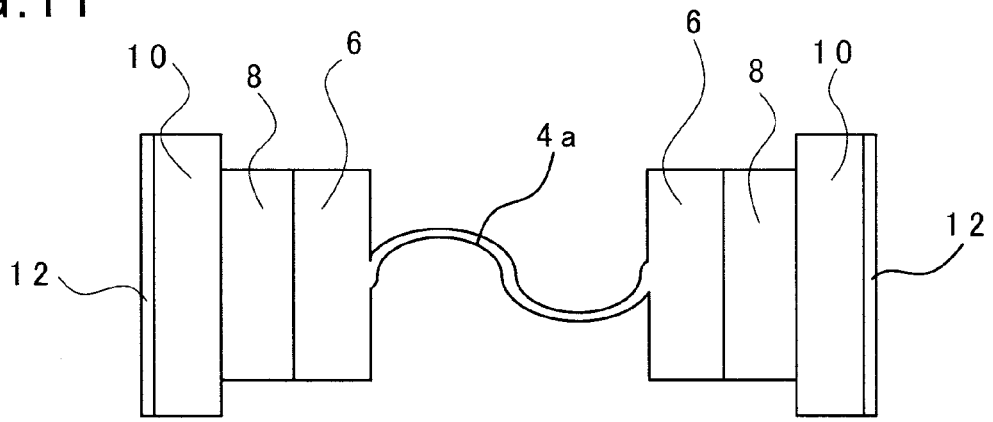
FIG. 11 is a plan view of a terminal-integrated fuse useable in a chip-type fuse of a modification of each of the above-mentioned embodiments.
Figure 12:
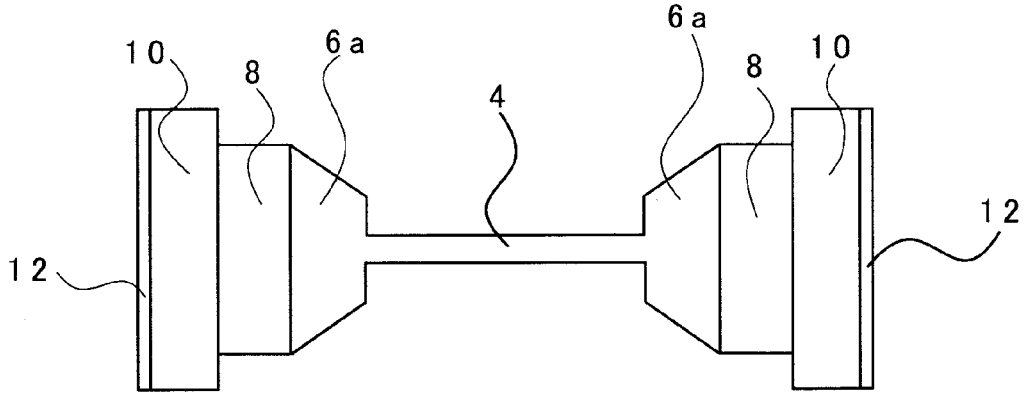
FIG. 12 is a plan view of a terminal-integrated fuse useable in a chip-type fuse of another modification of each of the above-mentioned embodiments.

In each of the described embodiments, the shape of the fuse body 4 used is straight in its plan, but the shape in plan is not limited to it. For example, a curvilinear fuse body, or, more specifically, a fuse body 4*a* having an S-shape in plan like the one shown in FIG. 11 may be used. Also, in each of the described embodiments, the shape of the coupling members 6 is rectangular, but it may be trapezoidal, with its width of the edge near the fuse body 4 being smaller, like coupling members 6*a* shown in FIG. 12.

Figure 13:
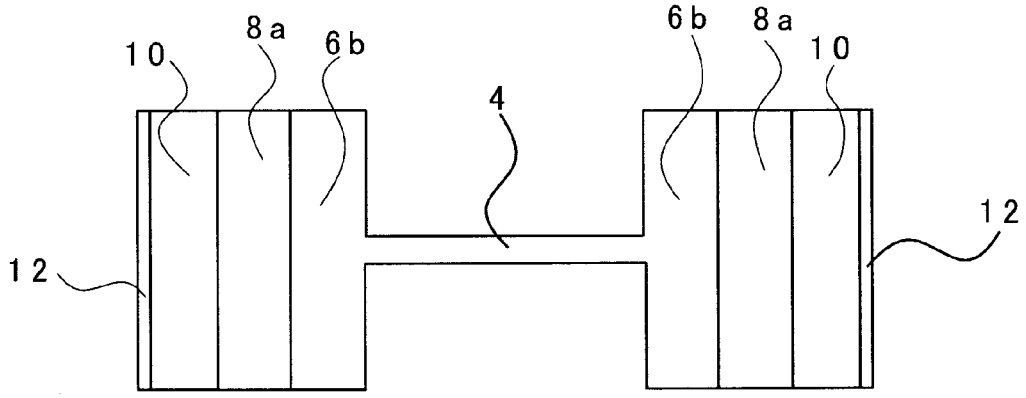
FIG. 13 is a plan view of a terminal-integrated fuse useable in a chip-type fuse of still other modification of each the above-mentioned embodiments.

The coupling members 6 and sloping members 8 of the described embodiments are shorter in length dimension than the planar members 10, but coupling members 6*b*, 6*b* and sloping members 8*a*, 8*a* having the same length dimension as the planar members 10 may be employed as shown in FIG. 13.

For the purpose of positioning the terminal-integrated fuse 2 in place with respect to the length direction of the fuse body 4, the joints between the sloping members 8, 8 and the planar members 10, 10 are placed in contact with the opening side edges of the respective end walls 22 and 24 in the described embodiments. However, if it is desired to reduce the heat transfer from the sloping members 8 and the planar members 6 as much as possible, the positioning of the terminal-integrated fuse 2 with respect to the casing 14 may be achieved by forming small projections extending toward the respective end walls 22 and 24 and/or small projections extending toward the respective side walls 18 and 20 at the junctions between the sloping members 8 and the planar members 10 so that the sloping members 8 and the planar members 10 do not directly contact the casing 14.

In the first and second embodiments, the plating layer 28 is formed over the outer surfaces of the planar members 10, 10 and risers 12, 12 of the terminal-integrated fuse 2 in the final step of the manufacturing process of the chip-type fuse. However, the plating layer 28 need not be formed in the last step, but it may be formed, for example, after placing the terminal-integrated fuse 2 within the casing 14 and before placing the silicone resin 28*a* and 28*b*.

According to the second embodiment, the bead layer 31 consists of a plurality of glass beads or hollow glass beads which are not linked to each other.

Instead, the glass beads may be treated at a temperature higher by several degrees centigrade or scores of degrees centigrade than the softening temperature of the glass beads or glass to thereby fuse together into a block, and the block can be used as the bead layer 31. In place of glass beads or hollow glass beads, cobalt chloride free beads of silica gel, zeolite, alumina, or the like may be used.

The invention claimed is:

1. A chip-type fuse comprising:

a terminal-integrated fuse including two planar members acting as terminals for mounting on a substrate, said two planar members being disposed on a same horizontal plane and spaced from each other, and a fuse positioned between said two planar members in a horizontal plane at a level different from the level of said horizontal plane on which said two planar members are disposed, said fuse being formed integrally with said two planar members;

a casing having one side closed and having the other side opened, said other side being located on a different horizontal plane than said one side, said casing having a peripheral wall extending from the periphery of the opening toward said one side, said fuse being positioned intermediate between said opening and said one side, said two planar members being in contact with said peripheral wall; and an arc suppressing material portion provided for said fuse within said casing.

2. The chip-type fuse according to claim 1, wherein said fuse is joined integral with edges, nearer to said opening, of said two planar members; and risers rise in the direction toward said one side from edges, nearer to outer surfaces of said peripheral walls, of said two planar members, said risers being in contact with said peripheral walls.

3. The chip-type fuse according to claim 2, wherein said edges, nearer to said opening, of said two planar members are in contact with the edge of said opening; and said fuse is joined integral with distal edges of sloping members sloping inwardly of said casing from said edges, nearer to said opening, of said two planar members.

4. The chip-type fuse according to claim 1, wherein said arc suppressing material portion embeds said fuse therein in said casing.

5. The chip-type fuse according to claim 4, wherein said arc suppressing material portion fills the entire inner space of said casing.

6. The chip-type fuse according to claim 4, wherein said opening is closed by a lid.

7. The chip-type fuse according to claim 1, wherein said arc suppressing material portion is disposed only in the vicinity of opposing ends of said fuse.

8. The chip-type fuse according to claim 7, wherein said opening is sealed up.

9. The chip-type fuse according to claim 8, wherein the sealing up of said opening is done by providing a plate member over said opening.

10. The chip-type fuse according to claim 8, wherein the sealing up of said opening is done by disposing a plate member within said casing and forming a resin layer between said plate member and said opening.

* * * * *